United States Patent [19]

Åkesson

[11] 4,189,254

[45] Feb. 19, 1980

[54] SYSTEM FOR THE STORAGE OF RADIOACTIVE MATERIAL

[75] Inventor: Bengt Å. Åkesson, Goteborg, Sweden

[73] Assignees: Tore Jerker Hallenius, Sundsvall; Karl Ivar Sagefor, Oregrund, both of Sweden

[21] Appl. No.: 917,410

[22] Filed: Jun. 21, 1978

[30] Foreign Application Priority Data

Jun. 30, 1977 [SE] Sweden ..... 7707639

[51] Int. Cl.[2] ..... G21F 7/00; E02D 29/00

[52] U.S. Cl. ..... 405/128; 252/301.1 W

[58] Field of Search ..... 252/301.1 W; 405/128

[56] References Cited

U.S. PATENT DOCUMENTS 3,925,992 12/1975 Backstrom ..... 405/53

3,996,751 12/1976 Hallenius et al. ..... 405/139

OTHER PUBLICATIONS

Quieser, H., "Treatment of Radioactive Slurry and Storage of Concentrated Waste", *Nuclear Eng. Int'l., Feb. 1975, pp. 108–110.*

*Primary Examiner*—Benjamin R. Padgett

*Assistant Examiner*—Deborah L. Kyle

*Attorney, Agent, or Firm*—LeBlanc, Nolan, Shur & Nies

[57] ABSTRACT

An underground repository for the storage of radioactive material. The repository consists of an inner cavity surrounded by a shell of rock. The shell of rock is surrounded by a shell of clay, and the body formed by the shells of rock and clay is enclosed in an outer underground cavity. A hollow cylindrical member is placed in an upright position inside the inner cavity. The space inside and outside the cylindrical member is filled with spherical bodies of concrete which are provided with through-going openings. Radioactive material formed into rods is accommodated in the openings in those spherical bodies which are placed in the lower part of the interior of the cylindrical member. The heat developed by the decay of the radioactive material causes air or other fluid inside the inner cavity to circulate upwards through the cylindrical member and downwards through the space between the outside of the cylindrical member and the wall of the inner cavity and through the openings in the spherical bodies and the interstices therebetween.

5 Claims, 4 Drawing Figures

SYSTEM FOR THE STORAGE OF RADIOACTIVE MATERIAL

The invention relates to a system for the storage of radioactive material in rock cavities. More particularly the invention relates to a repository for the storage of spent fuel from nuclear power plants and such high level waste that is produced during the reprocessing of spent nuclear fuel.

Systems for the storage of radioactive material in rock have previously been proposed. Such a system is described in the U.S. patent application Ser. No. 857,041 of Dec. 2, 1977, by Hallenius and Sagefors, and consists of an outer cavity in the rock. This cavity encloses a core of rock mass and is filled with clay so that the clay forms a shell around this core in which is provided an inner cavity which forms the storage space for the radioactive material. This inner cavity is provided with recesses for the accommodation of the radioactive material and communicates with a shaft for entering the radioactive material. This system is provided with an inner cooling system consisting of a plurality of conduits for a coolant. Each such conduit forms a closed loop which extends in a vertical plane along the inside of the inner cavity and along the outside of the core of rock. The system may also be provided with an outer cooling system consisting of a tunnel situated in the rock outside the shell of clay, said tunnel forming a helix which extends concentrically with the system in several turns along the total height of the system. The ends of the helical tunnel are joined in the rock at some distance from the repository, thereby forming a closed cooling system. Therefor, both the inner and the outer cooling system will operate according to the thermosiphon principle which means that coolant heated by the heat developed by the radioactive material rises upwards in the cooling system due to its lower density and is conveyed to a place within or outside the repository having a lower temperature where the coolant is cooled and returned to the hotter places in the repository. Thus, the circulation of the coolant is effected without the aid of any external machinery requiring the supply of energy from outside. However, this cooling system is relatively complicated. Also it is a disadvantage that it is difficult to calculate beforehand the dimensions of the cooling system and the whole repository in order that the dissipation of the generated heat shall be effective without causing dangerous temperature rises in the repository and its environment. For this reason the dimensions of the repository and the cooling system must be estimated with large safety margin which may make the construction costs unnecessarily high.

The present invention relates to a repository of the kind described above for the storage of radioactive material in rock. The repository comprises a substantially spherical cavity excavated in the rock. This cavity is surrounded by a shell of rock and this shell is surrounded by a shell of clay. The clay shell is surrounded by the rock formation.

It is an object of the invention to provide in a repository of this kind an effective distribution and dissipation of the heat generated by the stored radioactive material. The invention makes it possible to calculate beforehand with great accuracy the heat distribution and the temperature rise in the environment of the repository. Hereby it is also possible to calculate with great accuracy the dimensions of the repository so that the temperature in the rock and the clay shell does not reach dangerous values. The cooling system in the repository according to the invention also contributes to the mechanical stability of the repository and prevents the cavity from collapsing under the action of extremely high external forces.

According to the invention the repository is characterized in that a vertically standing tube-shaped member of a heat resistant and mechanically strong material is arranged within the cavity, which tubeshaped member divides the cavity into an outer space and an inner space and is provided at its top and bottom ends with openings connecting the outer space with the inner space, that both the inner space and the outer space are filled with substantially spherical bodies of a heat resistant and mechanically stable material which bodies are provided with through openings and arranged so that these openings extend at an angle to the horizontal plane, and that the radioactive material to be stored is formed into rods which are placed within said openings in some of the spherical bodies in such a way that the rods of radioactive material are at a certain distance from the inside of the openings, and that those of the spherical bodies which contain radioactive material are situated in the bottom part of the inner space in the tubeshaped member.

The tubeshaped member preferably consists of a cylindrical tube of reinforced concrete which is open at both ends and also is provided with openings around its periphery adjacent to its ends.

The said spherical bodies are also preferably made of reinforced concrete.

In the repository according to the invention air in the bottom part of the tubeshaped member will be heated by the radioactive material and caused to rise upwards within the tubeshaped member to its top end where the air is forced through the openings at the top end against the wall of the cavity where the air is cooled and flows downwards in the outer space between the tubeshaped member and the wall of the cavity, whereupon the air again flows into the tubeshaped member through the openings at its bottom end and again comes in contact with the radioactive material and is heated anew so that the flow cycle is repeated. The air flows through the spaces between the spherical bodies and through the openings in these bodies. Thus, the spherical bodies act as a porous mass which makes possible a relatively free and rapid air flow and simultaneously prevents the cavity from being compressed and collapsing under the action of high external forces.

The heat generated by the radioactive material is thus distributed by convection nearly uniformly over the whole cavity, and large temperature peaks in limited areas of the interior of the cavity are avoided.

The generated heat spreads through the rock surrounding the cavity and further on to the clay shell. Due to the spherical shape of the cavity it is relatively simple to calculate the temperature distribution in the environment of the cavity. For a given amount of stored radioactive material it is thus possible to estimate the variation with time of the temperature in the rock and the clay shell and the resulting maximum temperatures. These temperatures will of course be dependent of the dimensions of the rock mass and the clay shell, and it is therefore possible to determine beforehand these dimensions so that the temperature cannot assume critical values. By "critical values" of the temperature are meant such values which may cause undesirable changes in the rock and the clay, e.g. crumbling of the rock and drying-up of the clay so that it loses its plasticity.

The invention will now be described more in particular with reference to the accompanying drawings.

Figure 1:
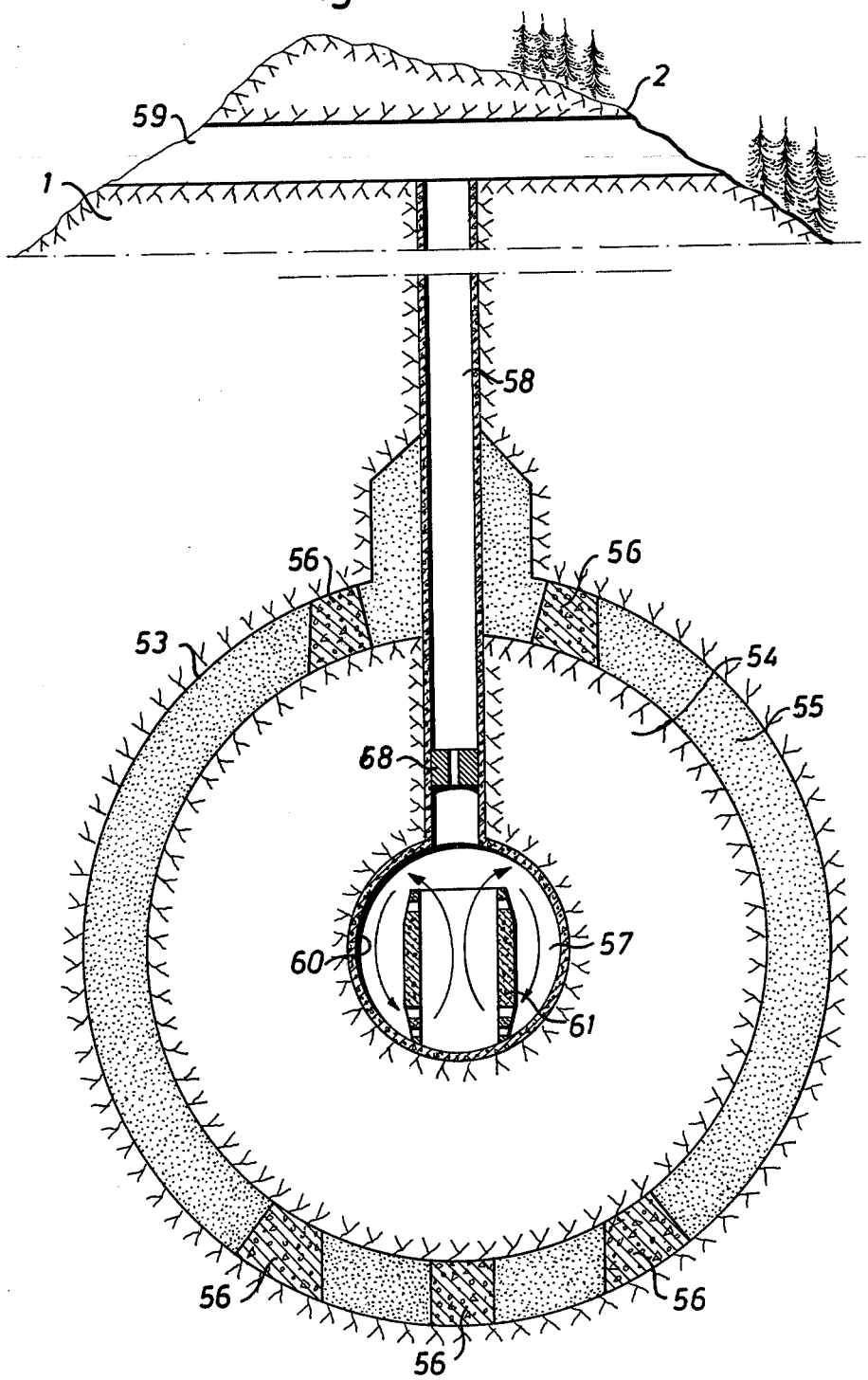
FIG. 1 shows schematically an embodiment of the repository according to the invention.

In the drawings 1 designates the bedrock in which the repository is located at a certain depth below the ground level 2. This depth may be for instance 300 to 600 meters. In the bedrock 1 there is excavated an outer cavity the outline of which is designated 53 in FIG. 1, and in this cavity there is left a core 54 of rock. The space between this rock 54 and the outer rock is filled with clay 55 which forms a shell enclosing the core 54 of rock. The core 54 is positioned in relation to the outer bedrock 1 by means of supporting members 56 which may consist of reinforced concrete or of left rock.

The core 54 contains an inner cavity 57 of a spherical form. Thus, the core 54 forms a shell of rock around the cavity 57. The cavity 57 communicates through a vertical shaft 58 with a horizontal tunnel 59 which is located adjacent to the ground level. The cavity 57 and the shaft 58 are lined with reinforced concrete 60.

Figure 3:
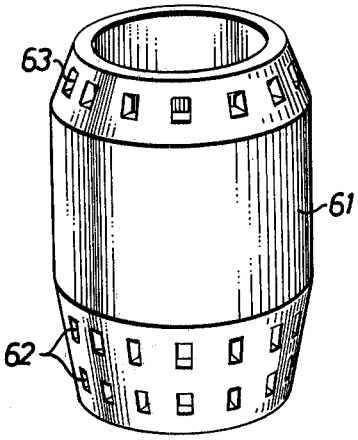
FIG. 3 shows in perspective view an embodiment of the tube-shaped member.

The cavity 57 constitutes the storage space for the radioactive material. A vertically standing cylinder 61 of reinforced concrete is placed within the cavity 57. This cylinder is shown in detail in FIG. 3. As seen in this figure the wall thickness of the cylinder may be larger in the central part of the cylinder and decrease towards the ends of the cylinder. At the lower end of cylinder 61 there are arranged two rows of ventilation holes 62 along the periphery of the cylinder. Adjacent to the top end of the cylinder there are also provided a row of holes 63 along the periphery of the cylinder wall. The cylinder 61 rests by its lower end on the bottom part of the cavity 57 while its upper end is at some distance from the top part of the cavity 57. Thus, the cylinder 61 divides the cavity 57 into an outer space between the outside of cylinder 61 and the wall of cavity 57 and an inner space formed by the interior of the cylinder. These spaces communicate with each other through the openings 62 in the lower end of the cylinder 61 and through the open upper end of the cylinder and the holes 63.

Figure 2:
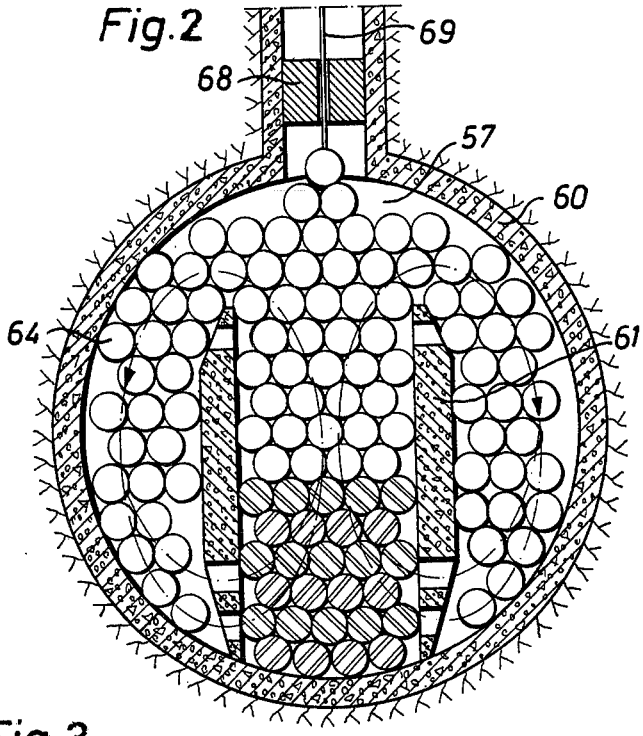
FIG. 2 shows on a larger scale the spherical cavity with the spherical bodies and the tube-shaped member.

As shown in FIG. 2 the space in cavity 57 which is not occupied by the cylinder 61 is filled with spherical bodies in the form of balls 64 of concrete which are all of the same diameter. Such a ball 64 is shown more in detail in FIG. 4. The ball is provided with a plurality of through cylindrical openings 65. In the embodiment shown in FIG. 4 there are three such openings. The openings 65 have the form of straight cylinders and seen in a cross-section at right angles to their axes they are so disposed that the center lines are at the corners of an equilateral triangle. Each ball 64 is provided with a hook or strap 66 which is anchored in the ball and by means of which the ball can be lifted and lowered. The balls 64 are so placed in the cavity 57 that the openings extend in a direction at a certain angle to horizontal plane. This angle should be such that the openings terminate in the spaces between the balls. The hook or strap 66 is so located in relation to the openings that when the ball is lowered into the cavity 57 hanging in the hook or strap 66, the openings 65 will automatically assume the desired direction.

All the balls 64, both those located outside and those located inside the cylinder 61, are provided with such openings 65. The purpose of these openings is to facilitate the circulation of air within the cavity 57.

The radioactive material to be stored in the repository is assumed to be solid and shaped into rods. Thus, spent fuel rods and fuel assemblies from a nuclear reactor can be stored without any further treatment in the repository according to the invention.

Figure 4:
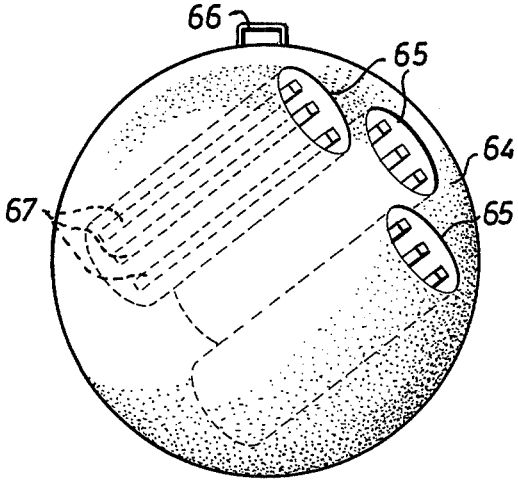
FIG. 4 shows one of the spherical bodies.

The rods of radioactive material are entered into the openings 65 in some of the balls 64, namely those balls that are placed within the cylinder 61 and preferably only in those balls 64 which are at the lower part of the interior of cylinder 61. Preferably the cylinder 61 is filled with balls 64 containing radioactive material only to one third of its height. The rods of radioactive material are placed in the openings 65 in the balls 64 in such a way that the rods are spaced from the insides of the openings 65 so that air can freely circulate through the openings along the rods of radioactive material. FIG. 4 shows some fuel assemblies 67 placed in the openings 65 in the ball 64. The rods are positioned within the openings 65 by means of suitable support means (not shown).

The cavity 57 is closed by means of a seal 68 located in the shaft 58 near its opening into the cavity 57. The cavity 57 may contain sensing means sensing temperature, pressure and radioactive radiation. These sensing means could be connected with measuring instruments located outside the repository by means of cables 69 which are drawn through the seal 68 and the shaft 58.

The construction of the repository can be effected by the use of rock blasting methods well known in the art and will therefore not be described more in particular. The cavity 57 should be lined on its inside with heavily reinforced concrete. The concrete cylinder 61 is manufactured by casting on its place within the cavity 57. The space outside the cylinder 61 is filled with concrete balls 64 which are lowered through the shaft 58. Concrete balls 64 containing radioactive material are placed at the bottom of cylinder 61 and above these balls are placed concrete balls 64 not containing radioactive material.

The shaft 58 opens straight above the upper opening of cylinder 61. If so desired the balls 64 can easily be removed from the interior of the cylinder, which may be desirable for instance if the stored radioactive material is to be removed for reprocessing.

The tightly stacked concrete balls 64 which fill the cavity 57 contribute to preventing the cavity from collapsing. Therefore, the cavity can be given very large dimensions.

The dimensions of the repository will of course be dependent on the amount of radioactive material to be stored in it. A repository for the storage of 350 metric tons of spent fuel from a reactor will for instance have the following dimensions:

Radius of cavity 57=20 meters

Distance from the center of cavity 57 to the inner side of the clay barrier 55=65 meters The maximum temperature in shell 54 of rock will then amount to about 200° C. and the maximum temperature in the clay shell 55 to less than 50° C.

In the embodiment shown in FIG. 1 the clay shell 55 and the space occupied by this shell in the rock has a spherical shape. However, the clay shell 55 and the space occupied thereby could also have other shapes, e.g. cylindrical shape within the scope of the invention.

I claim:

1. a system for the storage of radioactive material in rock comprising a substantially spherical cavity excavated in the rock, said cavity being surrounded by a shell of rock and said shell being surrounded by a shell of clay, characterized in that within the cavity is arranged a vertically standing tubeshaped member of a heat resistant and mechanically strong material which divides the cavity into an outer space and an inner space and is provided at its lower and upper ends with openings connecting the outer space with the inner space, that both the inner space and the outer space are filled with substantially spherical bodies of a heat resistant and mechanically strong material which bodies are provided with through openings and arranged so that these openings extend at an angle to the horizontal plane, and that the radioactive material to be stored is formed into rods which are placed within said openings in part of said spherical bodies in such manner that the rods of radioactive material are at a certain distance from the insides of the openings, and that those spherical bodies which contain radioactive material are situated in the lower part of the interior of the tubeshaped member.

2. A system as claimed in claim 1, in which said tubeshaped member consists of a cylindrical tube of concrete which is open at both ends and also provided with apertures around its periphery adjacent to both ends.

3. A system as claimed in claim 1, in which said spherical bodies are made of concrete.

4. A system as claimed in claim 1, in which said spherical bodies are provided with hooks or straps for lifting and transport of the bodies.

5. A system as claimed in claim 1, in which the inside of the cavity is lined with a layer of reinforced concrete.

* * * * *